US012344948B2

(12) United States Patent
Matsuoka et al.

(10) Patent No.: US 12,344,948 B2
(45) Date of Patent: Jul. 1, 2025

(54) ELASTIC MATTRESS AND ELECTROLYZER

(71) Applicant: ASAHI KASEI KABUSHIKI KAISHA, Tokyo (JP)

(72) Inventors: Mamoru Matsuoka, Tokyo (JP); Kazuyuki Tsuchida, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 723 days.

(21) Appl. No.: 17/439,133

(22) PCT Filed: Mar. 18, 2020

(86) PCT No.: PCT/JP2020/012079
§ 371 (c)(1),
(2) Date: Sep. 14, 2021

(87) PCT Pub. No.: WO2020/189732
PCT Pub. Date: Sep. 24, 2020

(65) Prior Publication Data

US 2022/0145481 A1 May 12, 2022

(30) Foreign Application Priority Data

Mar. 18, 2019 (JP) ..... 2019-049867

(51) Int. Cl.
*C25B 13/00* (2006.01)
*C25B 1/26* (2006.01)
*C25B 9/19* (2021.01)

(52) U.S. Cl.
CPC ..... *C25B 13/00* (2013.01); *C25B 1/26* (2013.01); *C25B 9/19* (2021.01)

(58) Field of Classification Search
None
See application file for complete search history.

(56) References Cited

U.S. PATENT DOCUMENTS

| | | | |
|---|---|---|---|
| 4,340,452 | A | 7/1982 | deNora |
| 5,599,430 | A | 2/1997 | Pimlott et al. |
| 5,851,589 | A | 12/1998 | Nakayama et al. |
| 6,379,831 | B1 | 4/2002 | Draper |
| 6,495,006 | B1 | 12/2002 | Kimura et al. |

(Continued)

FOREIGN PATENT DOCUMENTS

| | | |
|---|---|---|
| CN | 1292043 | 4/2001 |
| CN | 1442512 | 9/2003 |

(Continued)

OTHER PUBLICATIONS

International Search Report issued in WIPO, Patent Application No. PCT/JP2020/012079, dated Jun. 9, 2020, English translation.

(Continued)

*Primary Examiner* — Louis J Rufo
(74) *Attorney, Agent, or Firm* — GREENBLUM & BERNSTEIN, P.L.C.

(57) ABSTRACT

An elastic mattress being conductive and including a plurality of hill parts and valley parts, which have been formed by a curved state of the elastic mattress, wherein the hill parts include concave parts having depths smaller than heights of the hill parts, and the valley parts include projections having heights smaller than depths of the valley parts.

12 Claims, 10 Drawing Sheets

(56) References Cited

U.S. PATENT DOCUMENTS

| | | | | |
|---|---|---|---|---|
| 7,323,090 | B2 | 1/2008 | Houda et al. | |
| 8,048,587 | B2 * | 11/2011 | Simpkins | H01M 8/0232 429/522 |
| 2003/0155232 | A1 | 8/2003 | Katayama et al. | |
| 2003/0188966 | A1 | 10/2003 | Katayama | |
| 2007/0278095 | A1 * | 12/2007 | Asaumi | C25B 11/036 204/283 |
| 2009/0071820 | A1 | 3/2009 | Saiki et al. | |
| 2013/0048493 | A1 | 2/2013 | Tissot et al. | |
| 2013/0299342 | A1 | 11/2013 | Suemoto et al. | |
| 2016/0237577 | A1 * | 8/2016 | Hatano | C25B 9/23 |
| 2017/0194655 | A1 * | 7/2017 | Yoshida | H01M 8/0254 |

FOREIGN PATENT DOCUMENTS

| | | |
|---|---|---|
| EP | 1 882 758 | 1/2008 |
| JP | S63-053272 | 3/1988 |
| JP | 2000-178781 | 6/2000 |
| JP | 2000-192276 | 7/2000 |
| JP | 2001-064792 | 3/2001 |
| JP | 2001-262387 | 9/2001 |
| JP | 2003-313690 | 11/2003 |
| JP | 2004-002993 | 1/2004 |
| JP | 2006120497 A * | 5/2006 |
| JP | 2006-322018 | 11/2006 |
| JP | 2012-140654 | 7/2012 |
| JP | 5047265 | 7/2012 |
| JP | 2014-037586 | 2/2014 |
| WO | 2012/091051 | 5/2012 |

OTHER PUBLICATIONS

International Preliminary Report on Patentability (IPRP) issued in WIPO, Patent Application No. PCT/JP2020/012079, dated Sep. 16, 2021, English translation.

Written Opinion of the International Searching Authority issued in WIPO, Patent Application No. PCT/JP2020/012079, dated Jun. 9, 2020, English translation.

European Search Report, European Patent Office, in EP Patent Application No. 20774034.1, dated Aug. 11, 2022 (in English).

European Search Report, in counterpart European Application No. 20774034.1, issued on Apr. 21, 2022 (in English).

* cited by examiner

ELASTIC MATTRESS AND ELECTROLYZER

TECHNICAL FIELD

The present invention relates to an elastic mattress and an electrolyzer.

BACKGROUND ART

Ion exchange membrane methods are used for electrolysis using an alkaline metal chloride aqueous solution such as saline solution. The ion exchange membrane methods use an electrolyzer equipped with an ion exchange membrane. As the electrolyzer used for electrolysis, an electrolyzer with a thin solid electrolyte membrane substantially sandwiched between both anode and cathode electrodes to reduce a distance between the electrodes, a so-called zero-gap base electrolyzer is also proposed.

By adopting an elastic member for at least one of the members sandwiching the ion exchange membrane in the zero-gap base electrolyzer, even when a pressure fluctuates in an electrolytic cell, the elastic member can absorb stress that may lead to a breakage of the ion exchange membrane. As an example of such an elastic member, Patent Literature 1 discloses a cushion mattress, which is woven fabric using four 0.1 mm nickel wires, which is further processed into a corrugated cushion mattress of 9 mm in thickness and is used as an elastic mattress.

CITATION LIST

Patent Literature

Patent Literature 1: Japanese Patent Publication No. 5047265 Specification

SUMMARY OF INVENTION

Technical Problem

The elastic mattress is required to be able to maintain the shape (uncrushable) to such an extent that it can maintain zero gap even if it receives a reverse differential pressure. The nature indicating how easily the elastic mattress retains its thickness when it releases a load after being exposed to a reverse differential pressure is called "reverse differential pressure resistance." On a premise that the elastic mattress is applied to a zero-gap base electrolyzer, the elastic mattress preferably has high reverse differential pressure resistance, and, for example, increasing a repulsive force of the elastic mattress may secure sufficient reverse differential pressure resistance. However, when increasing the repulsive force of the elastic mattress, that is, providing a strong elastic mattress, a surface pressure given by the elastic mattress during operation of the electrolyzer (also referred to as a "normal surface pressure" in the present Specification) also tends to increase. A high normal surface pressure means that a high load is applied to the ion exchange membrane, and there is a high possibility of causing membrane damage. Here, the elastic mattress described in Patent Literature 1 is fabric of a nickel wire processed into a corrugated shape, and, for example, using a stack of a plurality of nickel wire fabrics can further improve the reverse differential pressure resistance and make the elastic mattress harder to crush, whereas the surface pressure during normal operation tends to increase at the same time. That is, the technique described in Patent Literature 1 may cause damage to the ion exchange membrane due to excessively high surface pressure during normal operation. Thus, there is a trade-off relationship between maintenance of a zero-gap structure and prevention of membrane damage in the prior art when the pressure in the electrolytic cell fluctuates. That is, there is room for improvement in the elastic mattress described in Patent Literature 1 from the standpoint of an appropriate normal surface pressure, and there is a demand for an elastic mattress capable of achieving both maintenance of the zero-gap structure and prevention of membrane damage.

The present invention has been implemented in view of the above-described problems of the prior art and it is an object of the present invention to provide an elastic mattress capable of giving, when applied to an electrolyzer, an appropriate normal surface pressure, preventing damage to an ion exchange membrane and also excelling in reverse differential pressure resistance, and the electrolyzer.

Solution to Problem

As a result of intensive research to solve the above-described problems, the present inventor et al. came up with the present invention by discovering that an elastic mattress having a specific shape or an elastic mattress having a specific parameter can solve the above-described problems.

That is, the present invention is as follows:

[1]

An elastic mattress being conductive and comprising a plurality of hill parts and valley parts, which have been formed by a curved state of the elastic mattress, wherein the hill parts comprise concave parts having depths smaller than heights of the hill parts, and the valley parts comprise projections having heights smaller than depths of the valley parts.

[2]

The elastic mattress according to [1], wherein a direction in which one hill part is formed is substantially parallel to a direction in which another hill part adjacent to the one hill part is formed, and a direction in which one valley part is formed is substantially parallel to a direction in which another valley part adjacent to the one valley part is formed.

[3]

The elastic mattress according to [1] or [2], wherein the hill parts and the valley parts give a herringbone pattern in a surface direction of the elastic mattress.

[4]

The elastic mattress according to [3], wherein the herringbone pattern has one inflection point and an inflection angle at the inflection point is 90° or more.

[5]

The elastic mattress according to any one of [1] to [4], wherein the elastic mattress is folded at any position.

[6]

An electrolyzer comprising:

an anode chamber comprising an anode;

a cathode chamber comprising the elastic mattress according to any one of [1] to [5], a current collector and a cathode; and an ion exchange membrane disposed between the anode chamber and the cathode chamber, wherein the elastic mattress is disposed between the current collector and the cathode in the cathode chamber, and the elastic mattress applies a pressure in a direction toward the ion exchange membrane to the cathode.

[7]

An elastic mattress being conductive and having a thickness exceeding 2 mm, wherein (i) a repulsive force of the elastic mattress, which is measured when pressed such that the elastic mattress has a thickness of 2 mm, is 5 kPa or more and 30 kPa or less, and (ii) after the elastic mattress is compressed at a pressure of 40 kPa for 20 seconds, the elastic mattress has a thickness of 1 mm or more when the pressure is released.

Advantageous Effects of Invention

When applied to an electrolyzer, the elastic mattress of the present invention gives an appropriate normal surface pressure, and can achieve both prevention of damage to an ion exchange membrane and provision of high reverse differential pressure resistance.

BRIEF DESCRIPTION OF THE DRAWINGS

FIG. 8 (*b*) shows a partial schematic cross-sectional view corresponding to an X-X' cross section of FIG. 8 (*a*).

DESCRIPTION OF EMBODIMENTS

Figure 1:
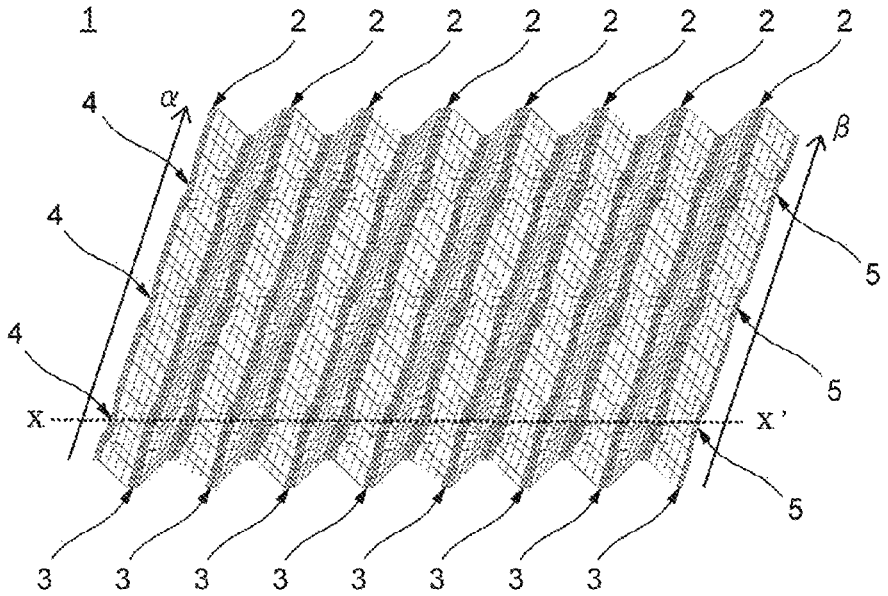
FIG. 1 shows a schematic perspective view illustrating an example of an elastic mattress according to the present embodiment.

Hereinafter, embodiments for implementing the present invention (hereinafter, referred to as "present embodiments") will be described in detail. Note that the present invention is not limited to the present embodiments descried below, but can be implemented by modifying it in various ways without departing from the spirit and scope of the present invention. Note that positional relationships such as up and down, left and right in the drawings are based on positional relationships shown in the drawings unless otherwise specified. Moreover, dimensional ratios among the drawings are not limited to the ratios illustrated therein.

[Elastic Mattress]

An elastic mattress according to a first aspect of the present embodiment (hereinafter referred to as a "first elastic mattress") is a conductive elastic mattress, and includes a plurality of hill parts and valley parts, which have been formed by a curved state of the elastic mattress, wherein the hill parts include concave parts having depths smaller than heights of the hill parts, and the valley parts include projections having heights smaller than depths of the valley parts. As described above, the first elastic mattress not only has a shape including hill parts and valley parts (simply a corrugated shape) but also is configured so that the hill parts include concave parts and the valley parts include projections, and so it is possible to reduce a normal surface pressure appropriately while improving reverse differential pressure resistance, and thus give an appropriate normal surface pressure when applied to the electrolyzer and prevent damage to the ion exchange membrane.

Furthermore, an elastic mattress according to a second aspect of the present embodiment (hereinafter also referred to as a "second elastic mattress") is a conductive elastic mattress having a thickness exceeding 2 mm, wherein (i) a repulsive force of the elastic mattress, which is measured when pressed such that the elastic mattress has a thickness of 2 mm, is 5 kPa or more and 30 kPa or less, and (ii) after the elastic mattress is compressed at a pressure of 40 kPa for 20 seconds, the elastic mattress has a thickness of 1 mm or more when the pressure is released. As described above, the second elastic mattress also has a predetermined parameter that falls within a predetermined range, and can therefore appropriately reduce a normal surface pressure while improving reverse differential pressure resistance, and give an appropriate normal surface pressure and prevent damage to the ion exchange membrane when applied to the electrolyzer.

Hereinafter, when the "elastic mattress of the present embodiment" is referred to, the "elastic mattress of the present embodiment" includes the first elastic mattress and the second elastic mattress unless specifically defined otherwise.

When performing electrolysis, the elastic mattress is normally preferably disposed between the current collector and the cathode to transmit electricity to the cathode and allow a hydrogen gas generated from the cathode to pass to the current collector side without resistance. At this time, the elastic mattress preferably functions so as to add, to the cathode in contact with the ion exchange membrane, an appropriate pressure, which is a pressure uniform and enough to prevent membrane damage and bring the ion exchange membrane into close contact with the cathode. From such a standpoint, it is preferable to adjust the material and size of the elastic mattress appropriately.

As for conductivity of the elastic mattress of the present embodiment, when the elastic mattress is applied to a zero-gap base electrolyzer, it suffices that the elastic mattress has conductivity enough to secure electrical connection with the adjacent current collector, and using, for example, a metal material or other conductive materials allow the elastic mattress to possess conductivity. As for the metal material, for example, but not limited to, nickel, iron, cobalt, molybdenum, lead or alloys thereof can be used, and nickel is preferable from the standpoint of conductivity and resistance to electrolyte solutions and electrolytic products.

With the present embodiment, by using an aggregate of wires made of the above-described metal material (metal wire) and preferably preparing a plurality of such metal wires and weaving the metal wires, it is possible to construct an elastic mattress intermediate in a cushion mattress shape. A wire diameter in this case is not particularly limited and various wire diameters can be adopted, but 0.05 mm to 0.25 mm is preferable from the standpoint of making the cushion mattress hard to crush and preventing the pushing pressure against the ion exchange membrane from becoming excessive. 0.10 mm to 0.25 mm is more preferable from the standpoint of reducing the likelihood of wire breakage, thereby preventing membrane damage and securing sufficient wire stiffness to thereby effectively prevent unevenness in surface pressure, further preferably 0.15 mm to 0.25 mm, still further preferably 0.16 mm to 0.25 mm and much more preferably 0.16 mm to 0.19 mm.

A wire weaving method is not particularly limited, but various well-known weaving methods can be adopted. For example, knitting in stockinette (stockinet) can be adopted in the present embodiment.

By making the aforementioned elastic mattress intermediate curved in a thickness direction, the first elastic mattress is to have a plurality of hill parts and valley parts. Furthermore, in the first elastic mattress, the hill parts include concave parts that have depths smaller than heights of the hill parts and the valley parts include projections that have heights smaller than depths of the valley parts. The second elastic mattress of the present embodiment also includes a plurality of hill parts and valley parts, which have been formed by the curved state of the elastic mattress, the hill parts preferably including concave parts that have depths smaller than heights of the hill parts and the valley parts preferably including projections that have heights smaller than depths of the valley parts.

In an example shown in FIG. 1, an elastic mattress 1 includes a hill part 2 at a left end, a valley part 3 formed adjacent thereto, another hill part 2 adjacent thereto, and such a configuration continues up to a valley part 3 at a right end. In the example shown in FIG. 1, the elastic mattress 1 has three concave parts 4 formed on the hill part 2 at the left end and has three projections 5 formed on the valley part 3 at the right end. Though reference numerals are omitted in FIG. 1, three concave parts are also formed on each of the other hill parts 2 and three projections are also formed on each of the other valley parts 3.

The numbers of hill parts, valley parts, concave parts and projections of the elastic mattress are not particularly limited, but can be set as appropriate. When applied to an electrolyzer, from the standpoint of providing a more appropriate normal surface pressure, a pitch (that is, a distance between vertexes of the adjacent hill parts or valley parts) in a direction perpendicular to the direction in which the hill parts and the valley parts of the elastic mattress are formed is preferably 3 to 15 mm, and more preferably 5 to 11 mm, and a pitch in a direction perpendicular to grooves in the concave parts and the projections is preferably 3 to 15 mm, and more preferably 5 to 11 mm.

Note that wires shown in a grid in FIG. 1 illustrate wires constituting the elastic mattress for convenience of description, but the wires are not limited to the wires in such a configuration, and the aforementioned hill parts, valley parts, concave part and projections are preferably formed in a cushion mattress with wires woven into stockinet as described above.

In the example shown in FIG. 1, the hill part 2 at the left end extends in a hill part forming direction $\alpha$ and a height of the hill part in the hill part forming direction $\alpha$ is substantially constant except three concave parts 4. The valley part 3 at the right end extends in a valley part forming direction $\beta$ and a height of the valley part in the valley part forming direction $\beta$ is substantially constant except three projections 5. In FIG. 1, the plurality of hill parts and valley parts are formed substantially parallel to one another in their forming directions, but the present embodiment also includes elastic mattresses where the plurality of hill parts and valley parts are not formed substantially parallel to one another and it is possible to obtain a uniform normal surface pressure.

Figure 2:
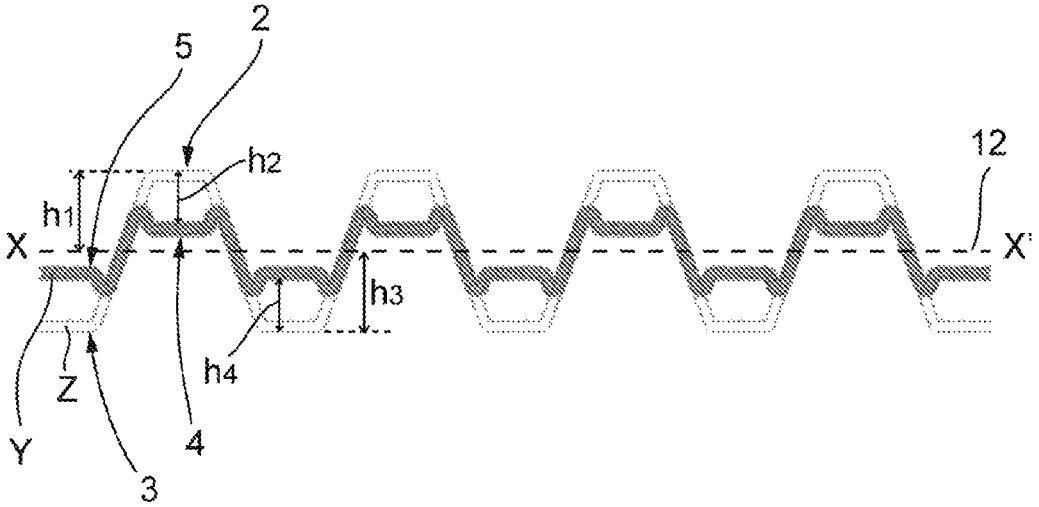
FIG. 2 shows a partial schematic cross-sectional view corresponding to an X-X' cross section in FIG. 1.

FIG. 2 shows a partial schematic cross-sectional view near the center of an X-X' cross section of the elastic mattress 1 in FIG. 1. The dotted line X-X' in FIG. 2 is a line perpendicular to the center in a thickness direction of the elastic mattress 1. Shapes represented by Y correspond to hill parts where concave parts are formed and valley parts where projections are formed, and located at the front in FIG. 2. Shapes represented by Z correspond to hill parts where no concave part is formed and valley parts where no projection is formed, and located at the rear in FIG. 2.

A height h1 represented by a normal from the dotted line X-X' to a highest point of the hill part where no concave part is formed corresponds to the "height of the hill part." A height h2 represented by a distance from a highest point of the hill part to a lowest point of the concave part corresponds to the "depth of the concave part." As shown in FIG. 2, a relationship h1>h2 holds in the elastic mattress of the present embodiment.

A height h3 represented by a normal from the dotted line X-X' to a lowest point of the valley part where no projection is formed corresponds to a "depth of the valley part." A height h4 represented by a distance from the lowest point of the valley part to a highest point of the projection corresponds to a "height of the concave part." As shown in FIG. 2, a relationship h3>h4 holds in the elastic mattress of the present embodiment.

Since the relationship among the hill parts, the valley parts, the concave parts and the projections satisfies the above-described relationship, the elastic mattress of the present embodiment, when applied to the electrolyzer, can give an appropriate normal surface pressure and prevent damage to the ion exchange membrane.

From a standpoint similar to the above-described standpoint, the value of h1 is preferably 1.8 to 3.0 mm, more preferably 2.0 to 2.8, the value of h2 is preferably 0.6 to 2.2 mm, more preferably 0.8 to 2.0 mm, the value of h3 is preferably 1.8 to 3.0 mm, more preferably 2.0 to 2.8 and the value of h4 is preferably 0.6 to 2.2 mm and more preferably 0.8 to 2.0 mm.

Figure 3:
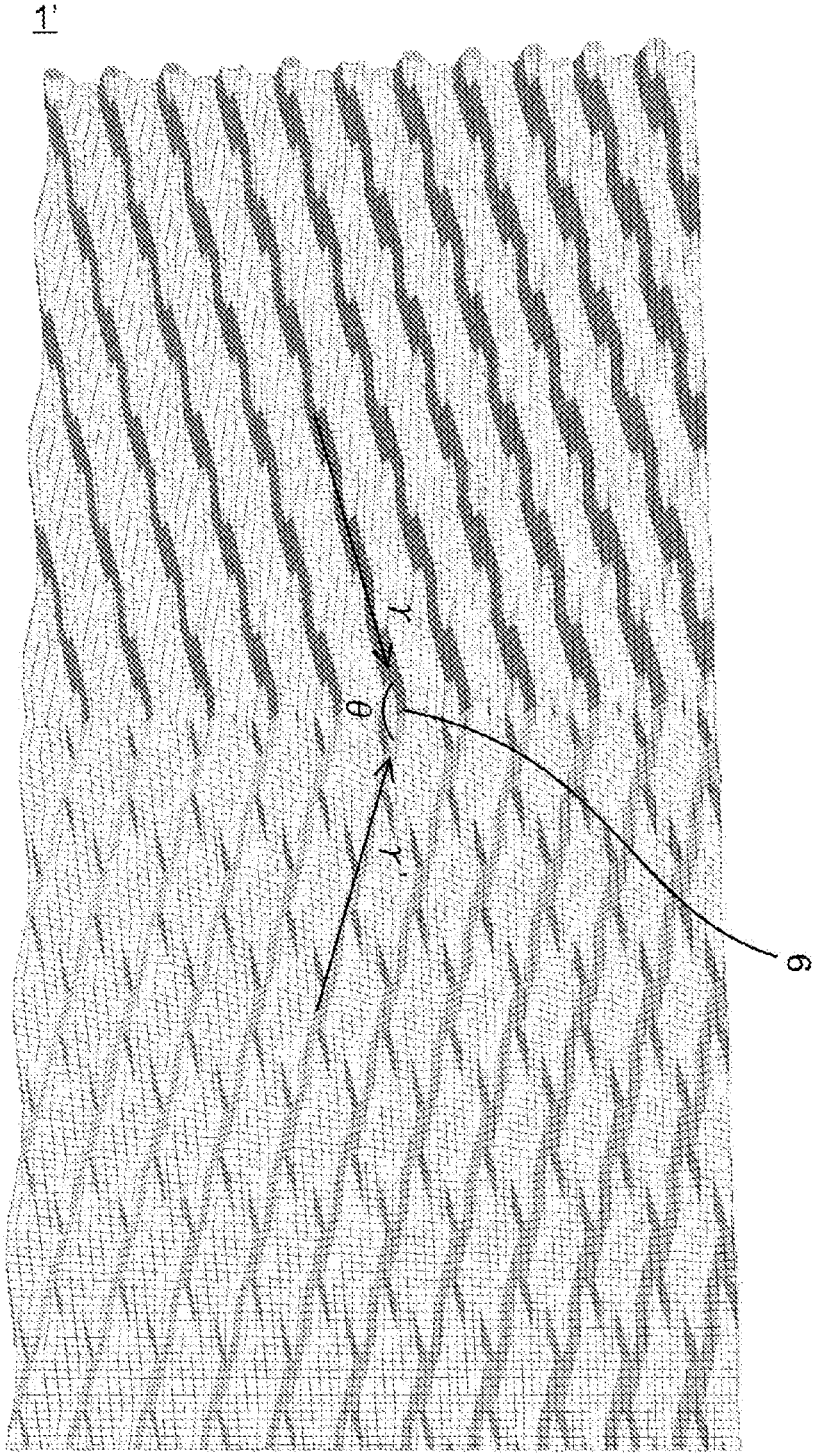
FIG. 3 shows a schematic perspective view illustrating an example of an aspect having a herringbone pattern of the elastic mattress according to the present embodiment.

In the present embodiment, the hill parts and the valley parts preferably provide a herringbone pattern in the surface direction of the elastic mattress. As shown in FIG. 3, the herringbone pattern includes an inflection point 6 where a pattern inflects at an inflection angle $\theta$ formed by one hill part forming direction $\gamma$ and another hill part forming direction $\gamma'$. Thus, it is preferable that the number of inflection points in the herringbone pattern be one and that the inflection angle at the inflection point be 90° or more. In the present embodiment, if the shapes of the hill parts, the valley parts, the concave parts and the projections are more uniform, a more uniform repulsion characteristic tends to be obtained, and from such a standpoint, it is preferable to adjust the shape of the elastic mattress. Although not limited to the following, there is a possibility that the number of inflection points and the magnitude of inflection angle may also affect the repulsion characteristic, and from the aforementioned standpoint, for example, the number of inflection points may be set to one and the inflection angle θ may be set to 90° or more, or preferably 130 to 160°.

The thickness of the elastic mattress of the present embodiment is not particularly limited, but may be set as appropriate by taking into account the distance between the anode and the current collector disposed in the cathode chamber in a desired electrolyzer and flexibility of the elastic mattress or the like. When a typical electrolyzer is assumed, the thickness of the elastic mattress of the present embodiment can be set to approximately 0.5 mm to 20 mm, preferably 3 mm to 15 mm and more preferably 4 mm to 10 mm. The thickness of the elastic mattress of the present embodiment can be measured using a tensile/compression testing machine (product name SDT-201NA-SH manufactured by IMADA SEISAKUSHO CO., LTD.), and more specifically, can be measured using a method described in examples, which will be described later.

As flexibility of the elastic mattress of the present embodiment, for example, but not limited to, flexibility when a surface pressure generated during normal operation falls within a range of 2 kPa to 40 kPa can be used. When the surface pressure generated during normal operation is 2 kPa or more, the pushing pressure against the ion exchange membrane tends to increase sufficiently, whereas when the surface pressure generated during normal operation is 40 kPa or less, there is a tendency to prevent the pushing pressure against the ion exchange membrane from increasing excessively. From a similar standpoint, flexibility when a surface pressure generated during normal operation falls within a range of 13 kPa to 34 kPa is preferably used.

The elastic mattress of the present embodiment can also be used by being folded or without being folded at a desired position or a plurality of elastic mattresses can be used by being layered. Note that as described above, since the elastic mattress of the present embodiment is configured not simply to have a shape with hill parts and valley parts, but configured so that the hill parts include concave parts and the valley parts include projections respectively, it is possible to appropriately reduce the normal surface pressure while improving the reverse differential pressure resistance. Therefore, even when a plurality of elastic mattresses of the present embodiment is not layered to use (even when only one of them is used), the zero-gap structure and preventing membrane damages can be maintained at the same time.

When performing electrolysis in the present embodiment, it is preferable to attach the elastic mattress to the current collector as described above. Examples of a method for attaching the elastic mattress are not particularly limited but include a method for appropriately fixing the elastic mattress by spot welding and a method for fixing the elastic mattress using a resin pin or metallic wire or the like. On the other hand, use of the elastic mattress with the four sides folded to the current collector is more preferable than the aforementioned fixing method from the standpoint of ease of attachment to the electrolyzer and the standpoint of preventing breakage of the wire that can constitute the elastic mattress.

The repulsive force of the second elastic mattress (hereinafter also referred to as "parameter (i)") measured when the elastic mattress is pressed so that the thickness of the elastic mattress becomes 2 mm is 5 kPa or more and 30 kPa or less and the thickness of the elastic mattress when the elastic mattress is pressed at a pressure of 40 kPa for 20 seconds and then the pressure is released (hereinafter also referred to as "parameter (ii)") is 1 mm or more. Since parameter (i) is 5 kPa or more, the electrode and the ion exchange membrane come into contact with each other at a sufficient pressure, the second elastic mattress demonstrates excellent electrolysis performance and since parameter (i) is 30 kPa or less, which is an appropriate pressure, the pressure on the ion exchange membrane is not excessively strong and the second elastic mattress prevents damage to the ion exchange membrane excellently. From such a standpoint, parameter (i) is preferably 7 kPa or more and 28 kPa or less and more preferably 9 kPa or more and 27 kPa or less.

Furthermore, since parameter (ii) is 1 mm or more, the second elastic mattress demonstrates excellent electrolysis performance. From such a standpoint, parameter (ii) is preferably 1.2 mm or more, more preferably 1.5 mm or more and still more preferably 2.0 mm or more.

More specifically, parameters (i) and (ii) can be measured using methods described in examples, which will be described later. These parameters can be adjusted to fall within the above-described range, for example, by providing the repulsive force with a gradient in the surface direction of the elastic mattress. Example of such adjustment methods will be described later.

[Method for Manufacturing Elastic Mattress]

The method for manufacturing the elastic mattress of the present embodiment is not particularly limited but can include the following steps:

First, an elastic mattress intermediate having a desired shape is manufactured using a conductive elastic member.

Next, a metal die having a shape corresponding to the aforementioned hill parts, valley parts, concave parts and projections is prepared to thereby provide the elastic mattress intermediate with a desired shape.

In addition to the above-described method, the elastic mattress of the present embodiment can be manufactured by applying a set of gear rolls, a distance between tooth edges of which is adjusted as appropriate, to the elastic mattress intermediate.

Figure 11:
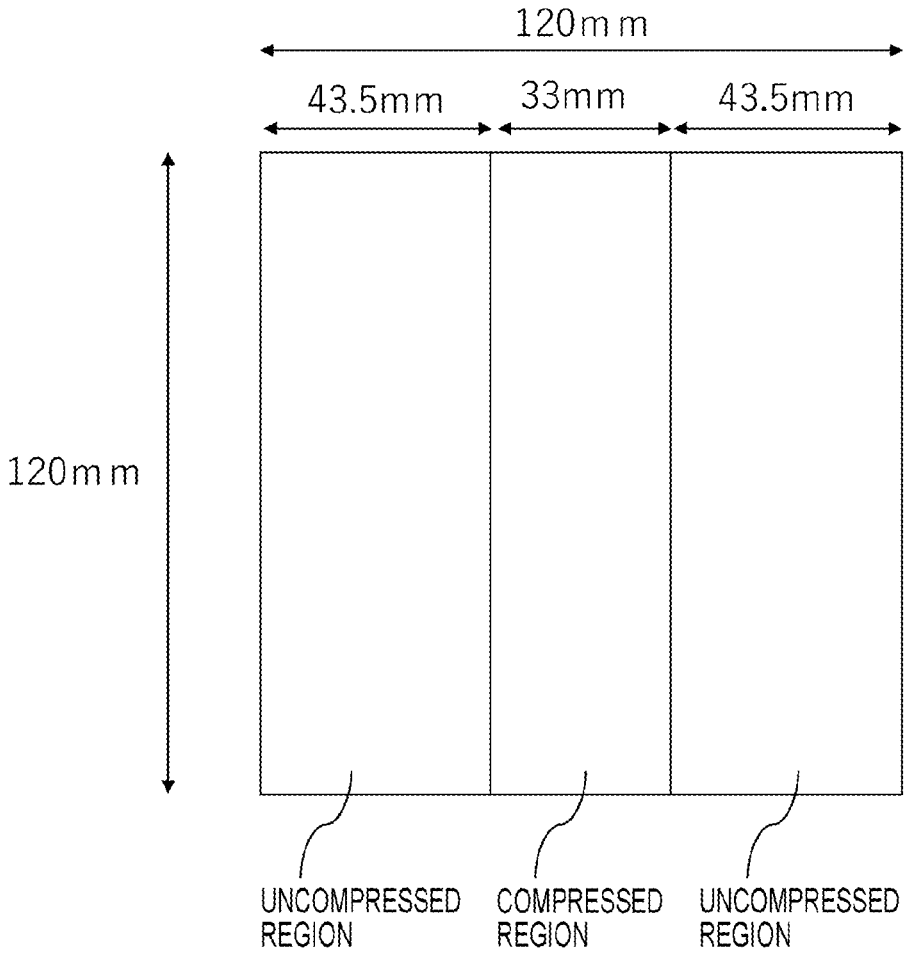
FIG. 11 shows an explanatory diagram illustrating a configuration of an elastic mattress in example 7.
Figure 12:
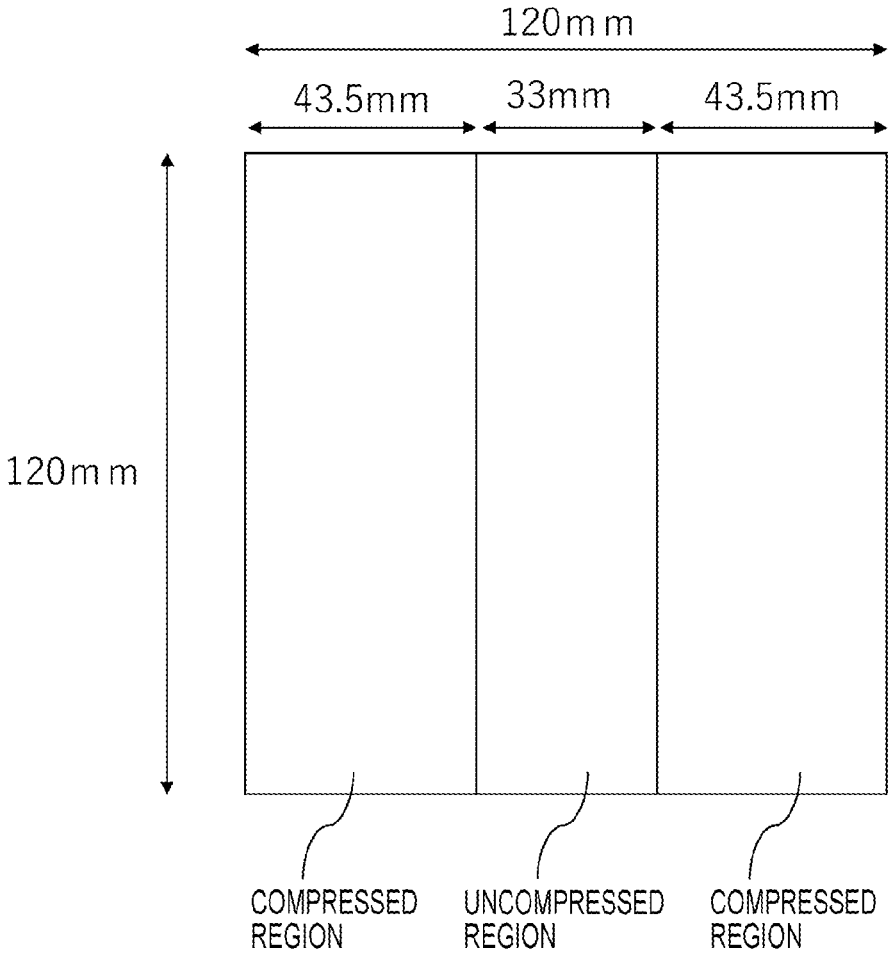
FIG. 12 shows an explanatory diagram illustrating a configuration of an elastic mattress in example 8.

As described above, the elastic mattress is required to have the ability to maintain the shape to an extent that it can maintain zero-gap even when a certain degree of reverse differential pressure is received (reverse differential pressure resistance) and is further required to also prevent the normal surface pressure from becoming excessively high. When trying to make the elastic mattress stronger to increase the reverse differential pressure resistance, the normal surface pressure tends to increase and the likelihood of causing membrane damage tends to increase. On the other hand, when trying to make the elastic mattress more flexible to reduce the normal surface pressure, the reverse differential pressure resistance tends to decrease, making it difficult to maintain the zero-gap. In this way, there is a trade-off relationship between maintenance of the zero-gap structure and membrane damage prevention, that is, it can be said that there is a trade-off relationship between keeping parameter (i) within an appropriate range and keeping parameter (ii) within an appropriate range in the prior art. The second elastic mattress is intended to solve such a problem of the prior art, and, for example, an elastic mattress that corresponds to the second elastic mattress but does not correspond to the first elastic mattress can be manufactured as follows:

First, one elastic mattress of desired size (that does not correspond to the first elastic mattress) is prepared, and this one elastic mattress is divided into three or more regions, for example. Next, at least one region is subjected to compression to reduce thickness and reduce the normal surface pressure, and it is thereby possible to manufacture the second elastic mattress. An arrangement of compressed regions and uncompressed regions is not particularly limited, and the regions may be preferably arranged alternately, for example, in order of uncompressed region, compressed region and uncompressed region (see example 7; FIG. 11, which will be described later) or in order of compressed region, uncompressed region and compressed region (see example 8;
FIG. 12, which will be described later).

The manufacturing method for the elastic mattress that corresponds to the second elastic mattress but does not correspond to the first elastic mattress is not limited to the above-described example, and, for example, such an elastic mattress can also be manufactured as follows:

First, one elastic mattress of desired size (that does not correspond to the first elastic mattress) is prepared, and samples are prepared by dividing this one elastic mattress into three or more regions, for example. Next, at least one region in the samples is subjected to compression to reduce the thickness and the normal surface pressure. Furthermore, it is possible to manufacture the second elastic mattress including the compressed region and the uncompressed region, for example, by integrating the sides of the compressed samples and the uncompressed samples (sides not in contact with the electrode or the current collector during operation of the electrolyzer). Although the "integration" here is not particularly limited, but the sides of the samples may be integrated, for example, by tangling or welding wires of the respective samples together or using a conductive adhesive. An arrangement of the compressed samples and the uncompressed samples is not particularly limited, and, for example, the regions may be preferably arranged alternately in order of the uncompressed region, the compressed region and the uncompressed region or in order of the compressed region, the uncompressed region and the compressed region.

Note that for the elastic mattress obtained in the aforementioned example, it is possible to control the value of parameter (i), for example, by adjusting an area ratio between the compressed region and the uncompressed region. For example, by increasing an area ratio S1/S2 between a total area S1 of the compressed regions and a total area S2 of the uncompressed regions, parameter (i) tends to decrease, and in this case, parameter (ii) tends to remain substantially unchanged. The value of parameter (ii) can be adjusted to the aforementioned range by using, for example, nickel, iron, cobalt, molybdenum, lead, or alloy thereof as the metal material constituting the elastic mattress or by adjusting a diameter of the wire made of metal material to, for example, on the order of 0.05 mm to 0.25 mm.

[Electrolyzer]

The electrolyzer of the present embodiment is provided with an anode chamber including an anode, the elastic mattress of the present embodiment, a cathode chamber including a current collector and a cathode, and an ion exchange membrane disposed between the anode chamber and the cathode chamber, in which the elastic mattress in the cathode chamber is disposed between the current collector and the cathode, and the elastic mattress applies a pressure to the cathode in a direction toward the ion exchange membrane. The electrolyzer in such a configuration can prevent damage to the ion exchange membrane and perform operation stably. In the present embodiment, a combination of the anode chamber and the cathode chamber is called an "electrolytic cell", which will be described in detail.

(Electrolytic Cell)

Figure 4:
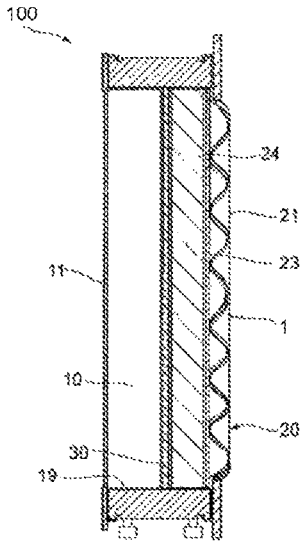
FIG. 4 shows a schematic cross-sectional view illustrating an example of an electrolytic cell to which the elastic mattress of the present embodiment is applied.

FIG. 4 is a schematic cross-sectional view illustrating an example of the electrolytic cell that constitutes the electrolyzer of the present embodiment. The electrolytic cell 100 is provided with an anode chamber 10, a cathode chamber 20, a partition wall 30 that separates the anode chamber 10 from the cathode chamber 20, an anode 11 disposed in the anode chamber 10, and a cathode 21 disposed in the cathode chamber 20. The anode 11 and the cathode 21 belonging to the one electrolytic cell 100 are electrically connected to each other.

The cathode chamber 20 further includes the cathode 21 disposed in the cathode chamber 20, a current collector 23, a support body 24 that supports the current collector and the elastic mattress 1. The elastic mattress 1 is disposed between the current collector 23 and the cathode 21. The support body 24 is disposed between the current collector 23 and the partition wall 30. The current collector 23 is electrically connected to the cathode 21 via the elastic mattress 1. The partition wall 30 is electrically connected to the current collector 23 via the support body 24. Therefore, the partition wall 30, the support body 24, the current collector 23, the elastic mattress 1 and the cathode 21 are electrically connected to one another. The cathode 21 and a reverse current absorber may be connected directly or connected indirectly via the current collector, the support body, the metal elastic body or the partition wall or the like. The entire surface of the cathode 21 is preferably covered with a catalyst layer for reduction reaction. A form of electrical connection may be such that the partition wall 30 and the support body 24, the support body 24 and the current collector 23, and the current collector 23 and the elastic mattress 1 may be directly attached respectively, and the cathode 21 is stacked on the elastic mattress 1. Examples of the method for directly attaching the respective components include welding and the aforementioned folding.

Since the elastic mattress 1 is disposed between the current collector 23 and the cathode 21, each cathode 21 of a plurality of serially connected electrolytic cells 100 is pushed against an ion exchange membrane 2, a distance between each anode 11 and each cathode 21 becomes shorter and a voltage applied to all the serially connected electrolytic cells 100 can be reduced. By reducing the voltage, the amount of power consumption can be reduced. According to the elastic mattress of the present embodiment, it is possible to apply a pressure to the ion exchange membrane with an appropriate atmospheric surface pressure as described above, thereby adopt a zero-gap configuration while maintaining current efficiency and further suitably prevent damage to the ion exchange membrane.

Note that a configuration in which the cathode is directly laid on the elastic mattress or a configuration in which the cathode is laid on the elastic mattress via another conductive member can be adopted. As a cathode available for the zero-gap, a cathode with a small wire diameter and a small number of meshes is highly flexible and therefore preferable. The wire material that constitutes such a cathode is not particularly limited, and, for example, a wire of 0.1 to 0.5 mm in wire diameter having mesh opening within a range on the order of 20 meshes to 80 meshes can be used.

Figure 5:
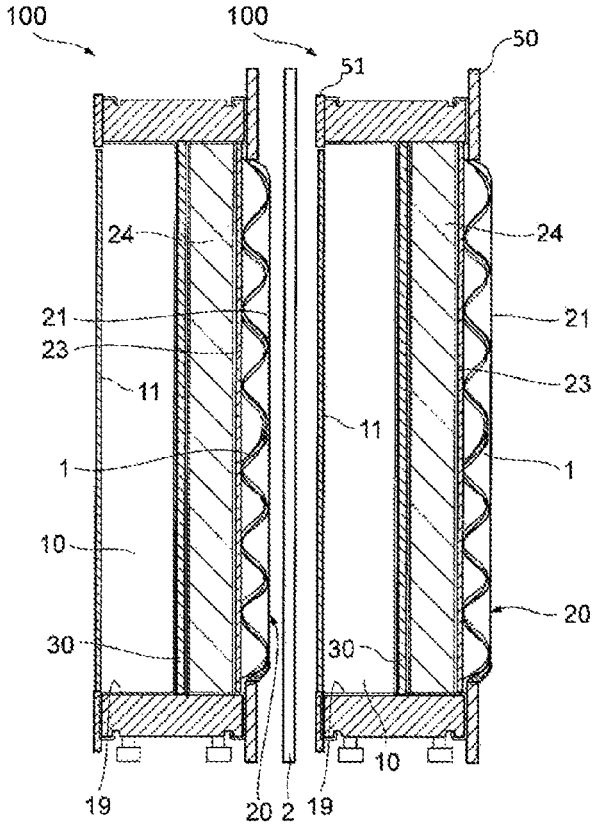
FIG. 5 shows an explanatory diagram illustrating a case where two electrolytic cells in FIG. 4 are connected in series.
Figure 6:
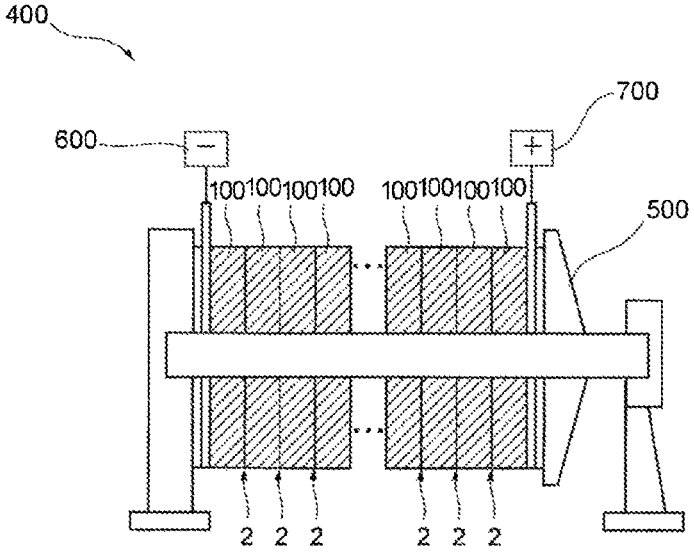
FIG. 6 shows an explanatory diagram illustrating an example of an electrolyzer of the present embodiment.
Figure 7:
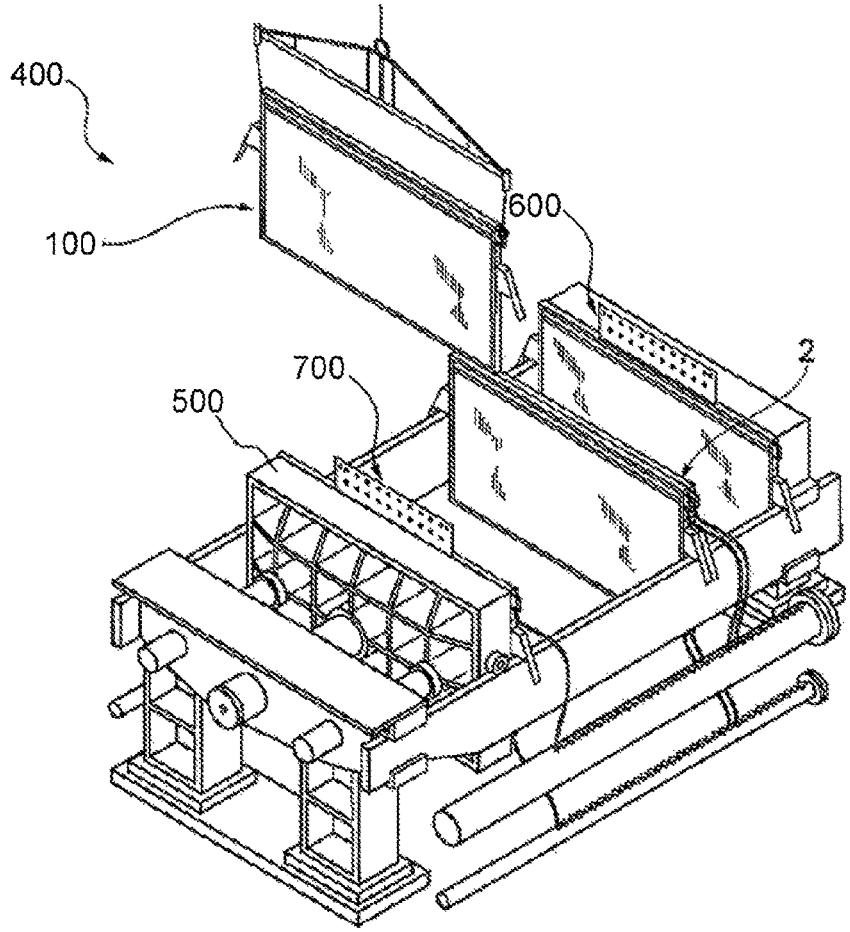
FIG. 7 shows an explanatory diagram illustrating an example of a process of assembling the electrolyzer of the present embodiment.

FIG. 5 is a cross-sectional view of two adjacent electrolytic cells 100 in the electrolyzer 4 of the present embodiment. FIG. 6 illustrates an electrolyzer 400. FIG. 7 illustrates a process of assembling the electrolyzer 400. As shown in FIG. 5, the electrolytic cell 100, the ion exchange membrane 2 and the electrolytic cell 100 are arranged in series in that order. In the electrolyzer, the ion exchange membrane 2 is disposed between the anode chamber of one of two adjacent electrolytic cells and the cathode chamber of the other electrolytic cell 100. That is, the anode chamber 10 of the electrolytic cell 100 and the cathode chamber 20 of the adjacent electrolytic cell 100 are separated by the ion exchange membrane 2. As shown in FIG. 6, the electrolyzer 400 is constructed of a plurality of electrolytic cells 100 connected in series via the ion exchange membranes 2. That is, the electrolyzer 400 is a bipolar electrolyzer provided with a plurality of electrolytic cells 100 disposed in series and the ion exchange membrane 2 disposed between the adjacent electrolytic cells 100. As shown in FIG. 7, the electrolyzer 400 is assembled by disposing the plurality of electrolytic cells 100 in series via the ion exchange membranes 2 and connecting them by a pressing device 500.

The electrolyzer 400 includes an anode terminal 700 connected to a power supply and a cathode terminal 600. The anode 11 of the electrolytic cell 100 located at the very end of the plurality of electrolytic cells 100 connected in series in the electrolyzer 400 is electrically connected to the anode terminal 700. The cathode 21 located at an end on the opposite side of the anode terminal 700 of the plurality of electrolytic cells 2 connected in series in the electrolyzer 400 is electrically connected to the cathode terminal 600. At the time of electrolysis, a current flows from the anode terminal 700 side toward the cathode terminal 600 via the anode and the cathode of each electrolytic cell 100. Note that an electrolytic cell (anode terminal cell) having only an anode chamber and an electrolytic cell (cathode terminal cell) having only a cathode chamber may be disposed at both ends of the connected electrolytic cell 100. In this case, the anode terminal 700 is connected to the anode terminal cell disposed at one end thereof and the cathode terminal 600 is connected to the cathode terminal cell disposed at the other end.

When performing electrolysis of salt water, salt water is supplied to each anode chamber 10 and pure water or a low concentration sodium hydroxide aqueous solution is supplied to the cathode chamber 20. Each liquid is supplied from an electrolyte solution supply pipe (not shown) to each electrolytic cell 100 via an electrolyte solution supply hose (not shown). The electrolyte solution and an electrolysis product are recovered by an electrolyte solution recovery pipe (not shown). During electrolysis, sodium ions in the salt water move from the anode chamber 10 of one electrolytic cell 100 to the cathode chamber 20 of the adjacent electrolytic cell 100 after passing through the ion exchange membrane 2. Thus, during electrolysis, a current flows in the direction in which the electrolytic cells 100 are connected in series. That is, the current flows from the anode chamber 10 toward the cathode chamber 20 via the ion exchange membrane 2. Along with the electrolysis of the salt water, a chlorine gas is generated on the anode 11 side and a sodium hydroxide (dissolved substance) and a hydrogen gas are generated on the cathode 21 side.

(Partition Wall)

The partition wall 30 is also called a "separator", disposed between the anode chamber 10 and the cathode chamber 20 and configured to separate the anode chamber 10 from the cathode chamber 20. For the partition wall 30, one well known as a separator for electrolysis can be used, and an example is a partition wall with a nickel plate welded to the cathode side and a titanium plate welded to the anode side.

(Anode Chamber)

The anode chamber 10 includes the anode 11. The anode chamber 10 preferably includes an anode-side electrolyte solution supply section that supplies an electrolyte solution to the anode chamber 10, a baffle plate disposed above the anode-side electrolyte solution supply section and disposed substantially parallel or diagonally to the partition wall 30, and an anode-side gas-liquid separation section disposed above the baffle plate and configured to separate the gas from the electrolyte solution mixed with the gas.

(Anode)

The anode 11 is provided within a frame of the anode chamber 10. As the anode 11, a metal electrode such as so-called "DSA" (registered trademark of De Nora Permelec Ltd.) can be used. The DSA is a titanium base material, a surface of which is covered with an oxide of ruthenium, iridium and titanium.

In the present embodiment, a distance between the anode and the reverse current absorption member in the electrolyzer is preferably 35 mm to 0.1 mm from the standpoint of damage to the ion exchange membrane used as the membrane.

(Anode-Side Electrolyte Solution Supply Section)

The anode-side electrolyte solution supply section is intended to supply an electrolyte solution to the anode chamber 10 and connected to the electrolyte solution supply pipe. The anode-side electrolyte solution supply section is preferably disposed below the anode chamber 10. As the anode-side electrolyte solution supply section, for example, a pipe (dispersion pipe) with an opening formed on the surface may be used. Such a pipe is more preferably disposed parallel to a base 19 of the electrolytic cell along the surface of the anode 11. This pipe is connected to the electrolyte solution supply pipe (liquid supply nozzle) that supplies the electrolyte solution into the electrolytic cell 100. The electrolyte solution supplied from a liquid supply nozzle is transported into the electrolytic cell 100 through a pipe and supplied from an opening provided on the surface of the pipe into the anode chamber 10. Since the pipe is disposed parallel to the base 19 of the electrolytic cell along the surface of the anode 11, it is possible to supply the electrolyte solution into the anode chamber 10 uniformly, which is therefore preferable.

(Anode-Side Gas-Liquid Separation Section)

The anode-side gas-liquid separation section is preferably disposed above the baffle plate. During electrolysis, the anode-side gas-liquid separation section has a function of separating a generated gas such as a chlorine gas from the electrolyte solution. Note that "above" means an upward direction in the electrolytic cell 100 in FIG. 4 and "below" means a downward direction in the electrolytic cell 100 in FIG. 4 unless specifically defined otherwise.

During electrolysis, when a mixed phase of a generated gas generated in the electrolytic cell 100 and the electrolytic solution (gas-liquid mixed phase) is produced and discharged out of the system, vibration is generated due to a pressure variation in the electrolytic cell 100, which may cause physical damage to the ion exchange membrane. To prevent this, the electrolytic cell 100 of the present embodiment is preferably provided with the anode-side gas-liquid separation section to separate the gas from the liquid. A defoaming plate that erases bubbles is preferably disposed in the anode-side gas-liquid separation section. When the gas-liquid mixed phase flow passes through the defoaming plate, bubbles burst and it is thereby possible to separate the electrolyte solution from the gas. As a result, it is possible to prevent vibration during electrolysis.

(Baffle Plate)

The baffle plate is preferably disposed above the anode-side electrolyte solution supply section and disposed substantially parallel or diagonally to the partition wall 30. The baffle plate is a partition plate to control the flow of the electrolyte solution in the anode chamber 10. Providing the baffle plate allows the electrolyte solution (e.g., salt water) to circulate internally in the anode chamber 10, and allows the concentration of the electrolyte solution to become uniform. To initiate internal circulation, the baffle plate is preferably disposed in such a way as to separate a space near the anode 11 from a space near the partition wall 30. From such a standpoint, the baffle plate is preferably provided so as to face the respective surfaces of the anode 11 and the partition wall 30. As the electrolysis progresses, the concentration of the electrolyte solution (salt water concentration) decreases in the space near the anode partitioned by the baffle plate and a generated gas such as a chlorine gas is generated. This produces a gas-liquid specific gravity difference between the space near the anode 11 partitioned by the baffle plate and the space near the partition wall 30. Using this, it is possible to promote internal circulation of the electrolyte solution in the anode chamber 10 and make concentration distribution of the electrolyte solution in the anode chamber 10 more uniform.

Note that though not shown in FIG. 4, another current collector may be provided separately in the anode chamber 10. As such a current collector, it is possible to adopt a material and a configuration similar to those of the current collector in the cathode chamber, which will be described later. The anode 11 itself can also be caused to function as the current collector in the anode chamber 10.

(Cathode Chamber)

The cathode chamber 20 includes the cathode 21 and the reverse current absorber, and the cathode 21 and the reverse current absorber are electrically connected. Like the anode chamber 10, the cathode chamber 20 also preferably includes a cathode-side electrolyte solution supply section, a cathode-side gas-liquid separation section and a baffle plate. Note that description of components of the cathode chamber 20 similar to the components of the anode chamber 10 will be omitted.

(Current Collector)

The cathode chamber 20 is preferably provided with the current collector 23. This improves a current collection effect. In the example shown in FIG. 4, the current collector 23 has a plate-like shape and the current collector and the cathode 21 are preferably disposed such that their respective surfaces are substantially parallel to each other in the present embodiment. Such a current collector tends to obtain a current collection effect while suppressing a deflection of the metal elastic body, which will be described later.

The current collector 23 is preferably made of an electrically conductive metal such as nickel, iron, copper, silver or titanium. The current collector 23 may be a mixture, alloy or composite oxide of these metals. Note that the shape of the current collector 23 may be any shape as long as it allows the current collector 23 to function as a current collector, and it may be a reticulated shape.

(Support Body)

The cathode chamber 20 is preferably provided with the support body 24 that electrically connects the current collector 23 with the partition wall 30. This makes it possible to cause a current to flow efficiently.

The support body 24 is preferably made of an electrically conductive metal such as nickel, iron, copper, silver or titanium. The shape of the support body 24 may be any shape as long as it can support the current collector 23, and may be bar-shaped, plate-shaped or reticulated shape. In the form shown in FIG. 4, the support body 24 is plate-shaped and preferably has a configuration in which a metal plate is curved into an L-shape. The plurality of support bodies 24 are disposed between the partition wall 30 and the current collector 23. The plurality of support bodies 24 are arranged side by side such that the respective surfaces are parallel to one another. The support body 24 is disposed substantially perpendicular to the partition wall 30 and the current collector 23.

(Baffle Plate)

The baffle plate is preferably disposed above the cathode-side electrolyte solution supply section and substantially parallel or diagonally to the partition wall 30. The baffle plate is a partition plate that controls the flow of the electrolyte solution of the cathode chamber 20. Providing the baffle plate allows the electrolyte solution (e.g., salt water) to circulate internally in the cathode chamber 20, and allows the concentration of the electrolyte solution to be uniform. To initiate internal circulation, the baffle plate is preferably disposed in such a way as to separate the space near the cathode 21 from the space near the partition wall 30. From such a standpoint, the baffle plate is preferably provided so as to face the respective surfaces of the cathode 21 and the partition wall 30. As the electrolysis progresses, the concentration of the electrolyte solution (salt water concentration) decreases in the space near the cathode partitioned by the baffle plate and a generated gas such as a hydrogen gas is generated. This produces a gas-liquid specific gravity difference between the space near the cathode 21 partitioned by the baffle plate and the space near the partition wall 30. Using this, it is possible to promote internal circulation of the electrolyte solution in the cathode chamber 20 and make concentration distribution of the electrolyte solution in the cathode chamber 20 more uniform.

(Anode-Side Gasket, Cathode-Side Gasket)

The anode-side gasket 51 is preferably disposed on the surface of a frame body that constitutes the anode chamber 10. The cathode-side gasket 50 is preferably disposed on the surface of a frame body that constitutes the cathode chamber 20. The electrolytic cells are connected to one another so that the anode-side gasket 51 provided for one electrolytic cell and the cathode-side gasket 50 of the adjacent electrolytic cell sandwich the ion exchange membrane 2 (see FIG. 6). When connecting the plurality of electrolytic cells 100 in series via the ion exchange membrane 2, these gaskets can give air tightness to connection points.

The gasket is intended to seal between the ion exchange membrane and the electrolytic cell. A specific example of the gasket is a frame-like rubber sheet with an opening formed at a center. The gasket is required to demonstrate resistance to a corrosive electrolyte solution and a generated gas or the like and also required to be usable for a long period of time. Thus, an article obtained by vulcanizing or peroxide-cross-linking ethylene-propylene-diene rubber (EPDM rubber), ethylene-propylene rubber (EPM rubber) or the like is normally used as the gasket from the standpoints of chemical resistance and hardness. Moreover, a gasket, a region contacting a liquid (liquid contact region) of which is covered with fluorine resin such as polytetrafluoroethylene (PTFE), tetrafluoroethylene-perfluoroalkyl vinyl ether copolymer (PFA), can be used. These gaskets need only to have an opening so as not to interfere with the flow of the electrolyte solution, and the shape is not particularly limited. For example, a frame-like gasket is pasted using an adhesive or the like along a periphery of each opening of an anode chamber frame that constitutes the anode chamber 10 or a cathode chamber frame that constitutes the cathode chamber 20. For example, when connecting two electrolytic cells 100 via the ion exchange membrane 2 (see FIG. 6), it is only necessary to fasten each electrolytic cell 100 to which the gasket is pasted via the ion exchange membrane 2. This makes it possible to prevent an electrolyte solution or an alkaline metal hydride, chlorine gas, hydrogen gas or the like generated by electrolysis from leaking to the outside of the electrolytic cell 100.

(Ion Exchange Membrane)

The ion exchange membrane 2 is not particularly limited and a well-known ion exchange membrane can be used. For example, when manufacturing chlorine and alkaline through electrolysis of alkali chloride or the like, a fluorine-containing ion exchange membrane is preferable from the standpoint that it demonstrates excellent heat resistance and excellent chemical resistance or the like. An example of the fluorine-containing ion exchange membrane is one having a function of selectively permeating ions generated during electrolysis and including a fluorine-containing polymer with an ion exchange group. Here, the "fluorine-containing polymer with an ion exchange group" refers to a fluorine-containing polymer with an ion exchange group or an ion exchange group precursor that can be an ion exchange group through hydrolysis. An example of such a fluorine-containing polymer is a melt-processable polymer consisting of a fluorinated hydrocarbon main chain with a functional group as a pendant side chain that can be converted to an ion exchange group by hydrolysis or the like.

EXAMPLES

Hereinafter, the present embodiment will be described in detail with examples. Note that, however, the present embodiment is not limited to the following examples.

Example 1

(Manufacturing of Elastic Mattress)

As a conductive material, a Ni wire of 0.17 mm in diameter was subjected to stockinet to obtain an elastic mattress intermediate 1 made up of fabric with mesh opening of 1.5×2.5 mm. A pattern was given to this elastic mattress intermediate using a set of herringbone gear rolls (gear roll 1) having a torsion angle θ of 15° (inflection angle 150°) to obtain an elastic mattress intermediate 2. By this operation, hill parts and valley parts were formed and the elastic mattress intermediate 2 had a thickness of 4.7 mm.

Next, a set of gear rolls (gear roll 2) similar to the gear roll 1 except in that the distance between tooth edges is different was prepared, concave parts in the hill parts and projections in the valley parts of the elastic mattress intermediate 2 were formed so that both parts had a difference in height of 1.1 mm, and thus, an elastic mattress (1.2 m×2.4 m) according to example 1 was obtained. At this time, the gear roll 2 was used so that a design obtained by inverting a design of herringbone transferred by the gear roll 1 would be further transferred to the elastic mattress intermediate 2.

Figure 8:
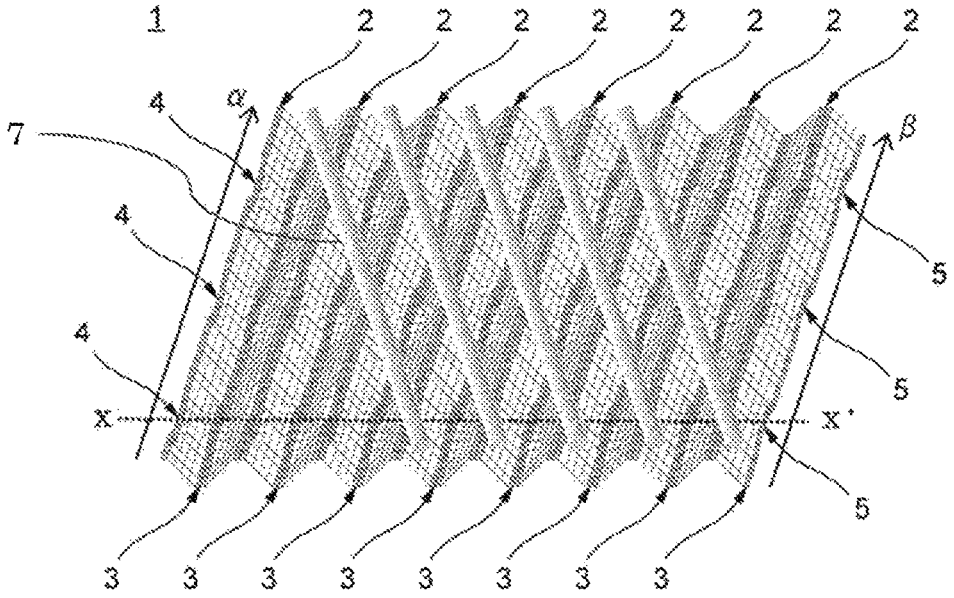
FIGS. 8 (*a*) and 8 (*b*) shows an explanatory diagram illustrating a method for measuring heights of hill parts, depths of concave parts, depths of valley parts and heights of projections of the elastic mattress in an example.
Figure 8:
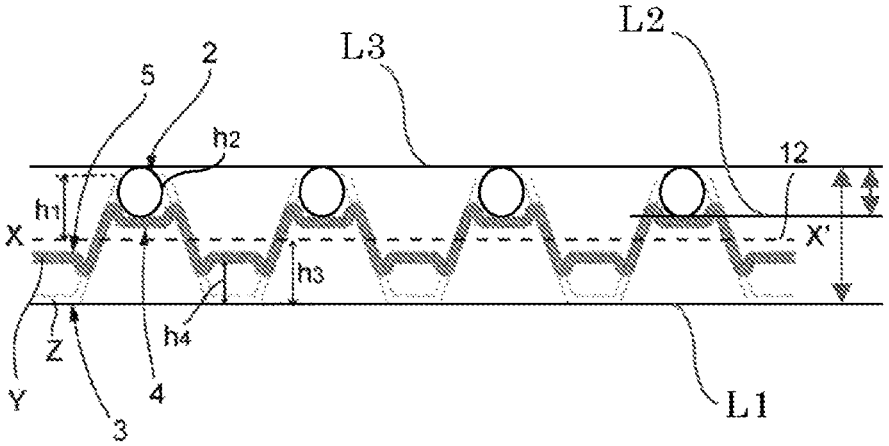

Heights of hill parts, depths of concave parts and depths of valley parts and heights of projections of the obtained elastic mattress were measured by placing a plurality of bars for measurement having a certain thickness on the elastic mattress as shown in FIG. 8(*a*) and by measuring each size using a mounting surface L1 of the elastic mattress, a virtual top surface L3 and a virtual undersurface L2 formed by the plurality of bars as shown in FIG. 8(*b*).

Note that the thicknesses of the elastic mattress intermediate and the elastic mattress were measured using a tensile/compression testing machine (product name SDT-201NA-SH manufactured by IMADA SEISAKUSHO CO., LTD.) provided with a fixed measurement stand and a vertically movable measurement plate (100 mm square; area 10,000 $mm^2$) as follows:

First, with nothing placed on the measurement stand of the tensile/compression testing machine, the measurement plate was made to descend to contact the elastic mattress and the position of the measurement plate at that time was set as height 0. Next, the measurement plate was made to ascend, the elastic mattress intermediate or the elastic mattress was placed on the measurement stand of the tensile/compression testing machine, the measurement plate was made to descend again so as to contact the elastic mattress intermediate or the elastic mattress, and then the position of the measurement plate was adjusted so that a reaction force became 0.1 kPa in terms of surface pressure. The height of the measurement plate in that case was set as the thickness of the elastic mattress intermediate or the elastic mattress. Thicknesses (initial thicknesses) were measured likewise in the following examples and comparative examples.

(Manufacturing of Electrolytic Cell)

A zero-gap base electrolytic cell of 2400 mm in breadth and 1289 mm in height was prepared as follows: a perforated nickel plate of 1149 mm×2347 mm in size and 1.2 mm in thickness was prepared as a current collector and the above-described elastic mattress was placed on the surface thereof. Next, using a rotating disk of 100 mm in diameter, the peripheral edges (all 4 sides) of the elastic mattress were curved so as to be located on a reverse side of the current collector via a gap formed between a frame body of the electrolytic cell and the edge of the current collector and was pushed in onto the reverse side of the current collector using a spatula so as to straddle the edge of the current collector. A folding length at this time was 10 mm.

Figure 9:
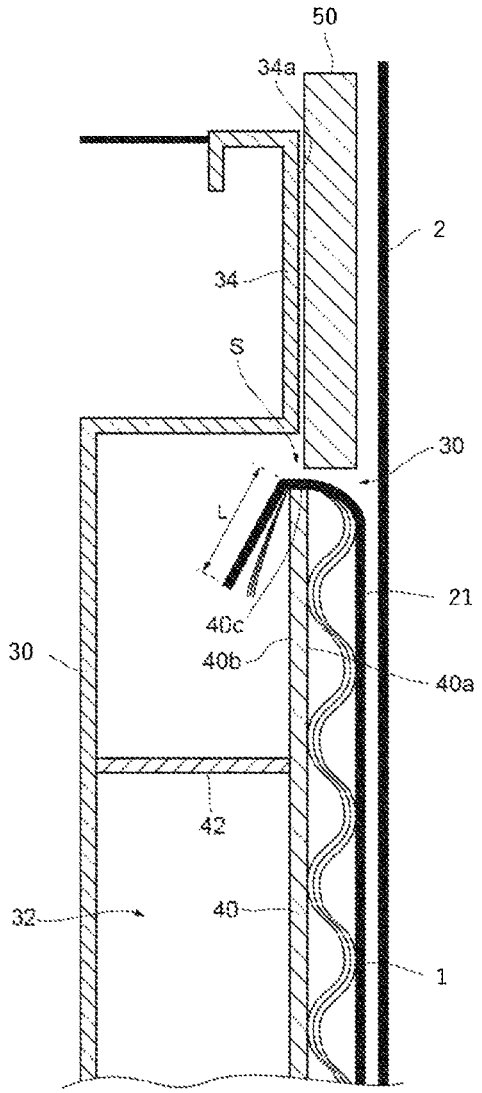
FIG. 9 shows a partial schematic cross-sectional view illustrating operation when assembling the elastic mattress of example 1 into the electrolytic cell.

Furthermore, the cathode, a nickel fine mesh base material of which was covered with a ruthenium oxide, was placed on the elastic mattress. As shown in FIG. 9, using the rotating disk of 100 mm in diameter, the peripheral edges (all 4 sides) of the cathode were curved. That is, a top end portion of the elastic mattress 1 and the cathode 21 was inserted into a gap S formed between a frame body 34 and an edge 40*c* of the current collector 40 and fixed so as to straddle the edge 40*c* of the current collector 40 and be folded back on the reverse side 40*b* side. A folding length L at this time was 10 mm.

(Electrolysis Evaluation)

The electrolytic cell was assembled into the electrolyzer, a titanium base material, a surface of which is covered with an oxide containing ruthenium and iridium as components was used as an anode, ACIPLEX (registered trademark) F6801 was used as an ion exchange membrane, salt water of approximately 300 g/L was supplied as an anode liquid, dilute caustic soda was supplied to the cathode chamber so that the concentration of the caustic soda would become approximately 32 weight % near a discharge port, electrolysis was performed for five days at an electrolysis temperature of 80 to 90° C., with an anode chamber side gas pressure of 40 kPa, cathode chamber side gas pressure of 44 kPa, and current density of 4 $kA/m^2$, and then the current density was increased up to 7 $kA/m^2$ and electrolysis was performed for a total of 28 days. Note that hydrochloric acid was added to salt water supplied so that pH of the salt water near the discharge port of the anode liquid would become 2 during the above-described electrolysis. When the ion exchange membrane was taken out after the electrolysis and visually checked, no abnormality was found in appearance. Next, when a surface layer coating of the ion exchange membrane was removed and observed, there were only 55 minor damages of the carboxylic acid layer (represented by "membrane damages" in the table), which was an extent of damages that would not affect electrolysis performance and the electrolytic cell kept a satisfactory condition.

Comparative Example 1

An elastic mattress according to comparative example 1 was obtained as in the case of example 1 except in that the gear roll 2 was not used. Such an elastic mattress was subjected to an electrolysis evaluation similar to that in example 1. The results are shown in Table 1. A release thickness after pressurization of 40 kPa was sufficient but since the surface pressure with a thickness of 2 mm was excessive, membrane damage occurred frequently.

(Surface Pressure)

Figure 10:
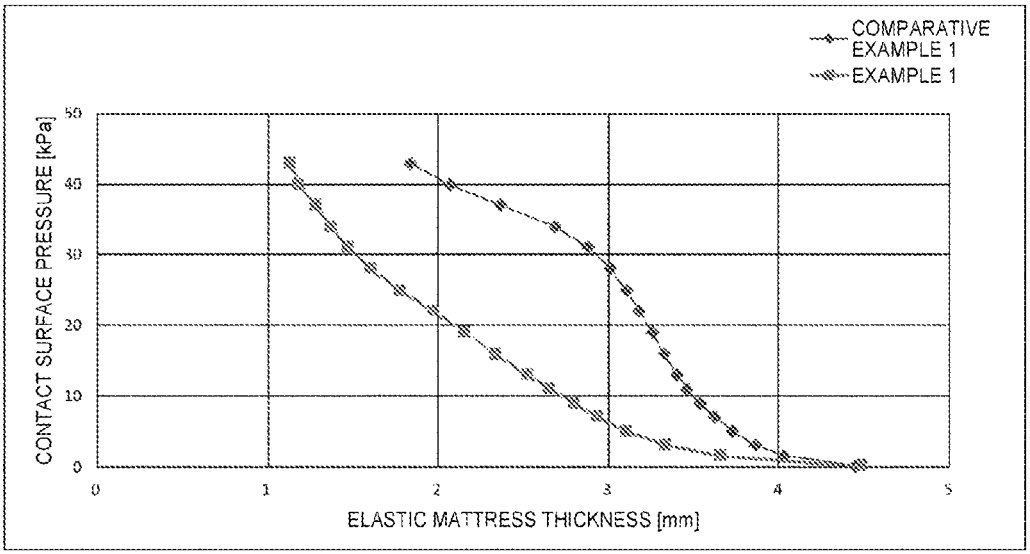
FIG. 10 shows a graph illustrating a relationship between a thickness and a contact surface pressure of the elastic mattress in example 1 and the elastic mattress in comparative example 1.

Targeting at the elastic mattresses obtained in example 1 and comparative example 1, a contact surface pressure with respect to a thickness of the elastic mattress was measured using a tensile/compression testing machine (product name SDT-201NA-SH manufactured by IMADA SEISAKUSHO CO., LTD.) as follows:

First, as described above, initial thicknesses of the elastic mattresses obtained in example 1 and comparative example 1 were measured. Next, the measurement plate was made to descend to contact the elastic mattress, the position of the measurement plate was adjusted and pressed so as to obtain a predetermined reaction force, the elastic mattress was held in that condition for 20 seconds, and the pressure and thickness at that time were recorded. The above-described operation was repeated while changing the value of the reaction force with each press, and a contact surface pressure with respect to a thickness of the elastic mattress was plotted. The results are shown in FIG. 10. Note that as the value of the reaction force (in terms of surface pressure), when the value of the reaction force at the first press is assumed to be 1.5 kPa, the reaction force was changed in subsequent presses in order of 3.0 kPa, 5.0 kPa, 7.0 kPa, 9.0 kPa, 11.0 kPa, 13.0 kPa, 16.0 kPa, 19.0 kPa, 22.0 kPa, 25.0 kPa, 28.0 kPa, 31.0 kPa, 34.0 kPa, 37.0 kPa, 40.0 kPa, and 43.0 kPa.

In the zero-gap base electrolyzer, the thickness of the elastic mattress (that corresponds to a gap between the current collector and the cathode during operation of the electrolyzer), is generally 2 to 3 mm, whereas according to FIG. 10, it is seen that the surface pressure of the elastic mattress according to example 1 decreases significantly in this range compared to comparative example 1.

Note that the surface pressure when the thickness of the elastic mattress was 2 mm was 23 kPa in example 1 and 41 kPa in comparative example 1.

(Release Thickness After Pressurization of 40 kPa)

Targeting at the obtained elastic mattress, a contact surface pressure with respect to a thickness of the elastic mattress was measured using the tensile/compression testing machine (product name SDT-201NA-SH manufactured by IMADA SEISAKUSHO CO., LTD.), which is the same as the machine described above, as follows: that is, with a measurement plate of 100 mm×100 mm (area 10,000 $mm^2$) kept in contact with the elastic mattress cut into 120 mm×120 mm in size (the one for which the aforementioned "surface pressure" measurement has not yet been performed) at a center, the elastic mattress was pressed until the reaction force indicated 40 kPa in terms of surface pressure, was kept in that condition for 20 seconds, the measurement plate was evacuated upward until the reaction force indicated 0.1 kPa and the thickness measured at that time was set as a release thickness.

Example 2

An elastic mattress according to example 2 was obtained as in the case of example 1 except in that the distance between tooth edges of the gear roll 2 was changed. Such an elastic mattress was subjected to an electrolysis evaluation similar to that in example 1. The results are shown in Table 1.

Example 3

An elastic mattress according to example 3 was obtained as in the case of example 1 except in that the distance between tooth edges of the gear roll 2 was changed. Such an elastic mattress was subjected to an electrolysis evaluation similar to that in example 1. The results are shown in Table 1.

Example 4

An elastic mattress according to example 4 was obtained as in the case of example 1 except in that the distance between tooth edges of the gear roll 2 was changed. Such an elastic mattress was subjected to an electrolysis evaluation similar to that in example 1. The results are shown in Table 1.

Example 5

An elastic mattress according to example 5 was obtained as in the case of example 1 except in that the distance between tooth edges of the gear roll 2 was changed. Such an elastic mattress was subjected to an electrolysis evaluation similar to that in example 1. The results are shown in Table 1.

Example 6

An elastic mattress according to example 6 was obtained as in the case of example 2 except in that the conductive material was changed to a Ni wire of 0.15 mm in diameter. Such an elastic mattress was subjected to an electrolysis evaluation similar to that in example 2. The results are shown in Table 1.

Example 7

The elastic mattress in comparative example 1 was cut out to a size of 120 mm in height and 120 mm in width. Next, the cut-out elastic mattress was divided into three regions as shown in FIG. 11, sample A obtained through compressing so that only the central region of 120 mm in height×33 mm in width would have a thickness of 1.6 mm was set as an elastic mattress according to example 7 (for evaluation of surface pressure and release thickness after pressurization of 40 kPa). This sample A was an area reference and had a compressed region of 33% and an uncompressed region of 67%.

The compressing was performed by placing the cut-out elastic mattress on a PVC plate having a sufficient thickness, using a tensile/compression testing machine and using a pressing plate (made of SUS) of 120 mm×33 mm in size.

Next, sample B obtained by subjecting the elastic mattress in comparative example 1 to compression without downsizing was set as an elastic mattress according to example 7 (for electrolysis evaluation). Note that a positional relationship and an area ratio among the uncompressed region, the compressed region and the uncompressed region in sample B were set to be similar to those in sample A.

Example 8

Just like example 7, the elastic mattress in comparative example 1 was cut out to a size of 120 mm in height and 120 mm in width. Next, the cut-out elastic mattress was divided into three regions as shown in FIG. 12, and sample C obtained by subjecting a region of 120 mm in height×43.5 mm in width at both ends to compression so as to have a thickness of 1.6 mm was set as an elastic mattress according to example 8 (for evaluation of surface pressure and release thickness after pressurization of 40 kPa). This sample C was an area reference and had a compressed region of 67% and an uncompressed region of 33%.

The compression processing was performed by placing the cut-out elastic mattress on a PVC plate of sufficient thickness, using a tensile/compression testing machine and placing two pressing plates (made of SUS) of 120 mm×45 mm in size at both ends of the elastic mattress.

Next, sample D obtained by subjecting the elastic mattress in comparative example 1 to compression without downsizing was set as an elastic mattress according to example 8 (for electrolysis evaluation). Note that a positional relationship and an area ratio among the compressed region, the uncompressed region and the compressed region in sample D were set to be similar to those in sample C.

For examples 2 to 8, surface pressures and release thicknesses after pressurization of 40 kPa were measured as in the cases of example 1 and comparative example 1. The results are shown in Table 1.

TABLE 1

| | Mattress thickness/mm | Hill-concave parts Valley-concave parts High-low difference h2, h4/mm | Heights of hill-valley parts h1, h3/mm | Membrane damage/ points | Surface pressure/ kPa | Release thickness after pressurization of 40 kPa/mm |
|---|---|---|---|---|---|---|
| Example 1 | 4.7 | 1.1 | 2.3 | 55 | 23 | 2.56 |
| Example 2 | 4.7 | 1 | 2.4 | 201 | 19 | 2.48 |
| Example 3 | 5 | 1.5 | 2.5 | 13 | 27 | 2.73 |
| Example 4 | 5 | 1.9 | 2.5 | 16 | 25 | 2.67 |
| Example 5 | 4.7 | 1.3 | 2.3 | 71 | 23 | 2.62 |
| Example 6 | 4.4 | 1.4 | 2.2 | 2 | 21 | 2.00 |
| Example 7 | 4.75 | — | — | 590 | 34 | 2.69 |
| Example 8 | 475 | — | — | 305 | 28 | 2.68 |
| Comparative example 1 | 4.9 | — | 2.5 | 1000 or more | 41 | 3.27 |

From Table 1, it is seen that damages to the ion exchange membrane are suppressed in examples 1 to 6 that satisfy the requirements of the first elastic mattress and in examples 7 and 8 that satisfy the requirements of the second elastic mattress more than in comparative example 1 that does not satisfy the requirements of the elastic mattress of the present embodiment.

Note that examples 7 and 8 were created based on comparative example 1, and the elastic mattress was obtained by integrating a portion compressed in advance and a portion uncompressed in advance, but since the repulsive force at a thickness of 2 mm was measured as an average surface pressure, the value thereof is smaller than that in comparative example 1. As a result, membrane damage can be reduced more than in comparative example 1.

The invention claimed is:

1. An elastic mattress, comprising:

an aggregate of metal wires; and wherein the elastic mattress is conductive and includes a plurality of hill parts and valley parts, which have been formed by a curved state of the elastic mattress, wherein the hill parts comprise concave parts having depths smaller than heights of the hill parts, wherein the concave parts are concaved inward with respect to a top plan view of the hill parts, and the valley parts comprise projections having heights smaller than depths of the valley parts.

2. The elastic mattress according to claim 1, wherein a direction in which one hill part is formed is substantially parallel to a direction in which another hill part adjacent to the one hill part is formed, and a direction in which one valley part is formed is substantially parallel to a direction in which another valley part adjacent to the one valley part is formed.

3. The elastic mattress according to claim 1, wherein the hill parts and the valley parts provide a herringbone pattern in a surface direction of the elastic mattress.

4. The elastic mattress according to claim 3, wherein the herringbone pattern has one inflection point and an inflection angle at the inflection point is 90° or more.

5. The elastic mattress according to claim 1, wherein the elastic mattress is folded at any position.

6. An electrolyzer comprising:

an anode chamber comprising an anode;

a cathode chamber comprising the elastic mattress according to claim 1, a current collector and a cathode; and an ion exchange membrane disposed between the anode chamber and the cathode chamber, wherein the elastic mattress is disposed between the current collector and the cathode in the cathode chamber, and the elastic mattress applies a pressure in a direction toward the ion exchange membrane to the cathode.

7. An elastic mattress being conductive and comprising a plurality of hill parts and valley parts, which have been formed by a curved state of the elastic mattress, wherein the hill parts comprise concave parts having depths smaller than heights of the hill parts, wherein the concave parts are concaved inward with respect to a top plan view of the hill parts, and the valley parts comprise projections having heights smaller than depths of the valley parts, wherein the elastic mattress has a thickness exceeding 2 mm and is configured such that:

(i) a repulsive force, which is measured when the elastic mattress is pressed to a thickness of 2 mm, is 5 kPa or more and 30 kPa or less, and ii) after the elastic mattress is compressed at a pressure of 40 kPa for 20 seconds, the elastic mattress has a thickness of 1 mm or more when the pressure is released.

8. The elastic mattress according to claim 7, wherein a direction in which one hill part is formed is substantially parallel to a direction in which another hill part adjacent to the one hill part is formed, and a direction in which one valley part is formed is substantially parallel to a direction in which another valley part adjacent to the one valley part is formed.

9. The elastic mattress according to claim 7, wherein the hill parts and the valley parts provide a herringbone pattern in a surface direction of the elastic mattress.

10. The elastic mattress according to claim 9, wherein the herringbone pattern has one inflection point and an inflection angle at the inflection point is 90° or more.

11. The elastic mattress according to claim 7, wherein the elastic mattress is folded at any position.

12. An electrolyzer comprising:

an anode chamber comprising an anode;

a cathode chamber comprising the elastic mattress according to claim 8, a current collector and a cathode; and an ion exchange membrane disposed between the anode chamber and the cathode chamber, wherein the elastic mattress is disposed between the current collector and the cathode in the cathode chamber, and the elastic mattress applies a pressure in a direction toward the ion exchange membrane to the cathode.

* * * * *